US011969137B2

(12) United States Patent
Kasper

(10) Patent No.: US 11,969,137 B2
(45) Date of Patent: Apr. 30, 2024

(54) VACUUM CLEANER

(71) Applicant: BISSELL Inc., Grand Rapids, MI (US)

(72) Inventor: Gary A. Kasper, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 326 days.

(21) Appl. No.: 17/152,038

(22) Filed: Jan. 19, 2021

(65) Prior Publication Data

US 2021/0137332 A1 May 13, 2021

Related U.S. Application Data

(60) Continuation of application No. 15/907,349, filed on Feb. 28, 2018, now Pat. No. 10,898,043, which is a division of application No. 14/475,750, filed on Sep. 3, 2014, now Pat. No. 9,962,051.

(60) Provisional application No. 61/873,615, filed on Sep. 4, 2013.

(51) Int. Cl.
*A47L 9/06* (2006.01)
*A47L 5/30* (2006.01)

(52) U.S. Cl.
CPC ..... *A47L 9/0633* (2013.01); *A47L 9/064* (2013.01); *A47L 9/0666* (2013.01); *A47L 5/30* (2013.01)

(58) Field of Classification Search
CPC ..... A47L 11/32; A47L 11/24; A47L 9/0666; A47L 9/0633
See application file for complete search history.

(56) References Cited

U.S. PATENT DOCUMENTS

| | | | | |
|---|---|---|---|---|
| 1,033,016 | A | 7/1912 | Hope | |
| 1,884,044 | A * | 10/1932 | Martinet | A47L 9/0673 15/369 |
| 3,209,385 | A | 10/1965 | Bruck | |
| 3,837,038 | A | 9/1974 | Kimzey et al. | |
| 4,091,496 | A | 5/1978 | Desrosiers et al. | |
| 4,864,682 | A * | 9/1989 | Bewley, Jr. | A47L 5/34 15/364 |
| 5,115,538 | A * | 5/1992 | Cochran | A47L 5/30 15/419 |
| 5,455,982 | A | 10/1995 | Armstrong et al. | |
| 5,671,499 | A * | 9/1997 | Melito | A47L 11/4025 15/377 |
| 6,817,059 | B2 * | 11/2004 | Tsuchiya | A47L 9/1409 15/345 |
| 6,832,409 | B2 | 12/2004 | Morgan et al. | |
| 7,013,521 | B2 | 3/2006 | Grey | |
| 7,334,284 | B2 | 2/2008 | Grey | |
| 7,350,268 | B2 | 4/2008 | Anderson et al. | |
| 7,665,172 | B1 * | 2/2010 | Tran | A47L 11/4075 15/83 |
| 8,732,897 | B2 * | 5/2014 | Jung | A47L 9/0466 15/93.1 |

(Continued)

FOREIGN PATENT DOCUMENTS

WO 2005053496 A1 6/2005

*Primary Examiner* — Bryan R Muller
(74) *Attorney, Agent, or Firm* — McGarry Bair

(57) ABSTRACT

A vacuum cleaner includes a housing having a suction nozzle opening, a source of suction in fluid communication with the suction nozzle opening for generating a working air stream through the housing, and a multiply-adjustable debris collecting blade coupled along the rear of the suction nozzle opening for collecting debris.

20 Claims, 12 Drawing Sheets

(56) References Cited

U.S. PATENT DOCUMENTS

| | | | |
|---|---|---|---|
| 2004/0049869 | A1 | 3/2004 | Tawara et al. |
| 2013/0145577 | A1 | 6/2013 | Davidshofer et al. |

* cited by examiner

VACUUM CLEANER

CROSS-REFERENCE TO RELATED APPLICATION

This application is a continuation of U.S. application Ser. No. 15/907,349, filed Feb. 28, 2018, now U.S. Pat. No. 10,898,043, issued Jan. 26, 2021, which is a divisional of U.S. application Ser. No. 14/475,750, filed Sep. 3, 2014, now U.S. Pat. No. 9,962,051, issued May 8, 2018, which claims the benefit of U.S. Provisional Application No. 61/873,615, filed Sep. 4, 2013, all of which are incorporated herein by reference in their entirety.

BACKGROUND

Vacuum cleaners can include a wiper blade or strip brush mounted adjacent to a suction nozzle opening for collecting dirt and debris, in addition to a main agitator, such as a rotatable brushroll. In some cases, the wiper blade or strip brush can be pivotally mounted to the nozzle housing for pivotal movement relative to the nozzle housing. Some vacuum cleaners can also include a mechanism for raising or lowering the agitator relative to the surface to be cleaned, which can simultaneously raise or lower the wiper blade or strip brush relative to the surface to be cleaned.

BRIEF DESCRIPTION

An aspect of the present disclosure relates to a vacuum cleaner, comprising a housing including a base at least partially defining a suction nozzle opening forming an inlet of the base, a suction source in fluid communication with the suction nozzle opening and adapted for generating a working airstream along a working air path, a wiper provided with the base, rearwardly of the suction nozzle opening, the wiper comprising a body at least selectively adapted to contact a surface to be cleaned, and a working air duct forming at least a portion of the working air path from the suction nozzle opening to the suction source, the working air duct provided with the base and adapted for reducing a size of the working air path.

DETAILED DESCRIPTION

The invention relates to vacuum cleaners and in particular to vacuum cleaners having an agitator assembly and a suction nozzle. In one of its aspects, the invention relates to an improved suction nozzle that houses an agitator and further comprises a debris collecting blade provided along the rearward edge of the suction nozzle and rearwardly of the agitator for collecting debris (which may include dirt, dust, soil, hair, and other debris). For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
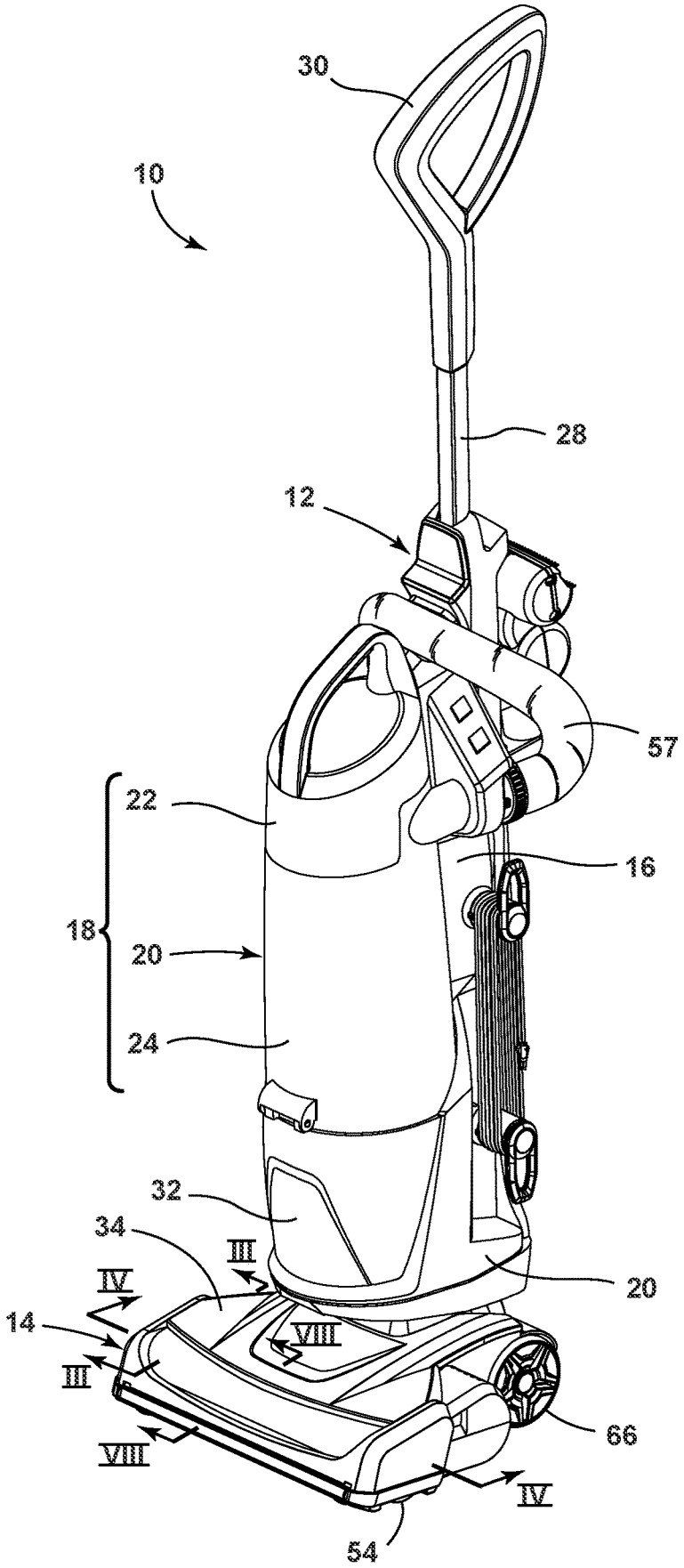
FIG. 1 is a perspective view of a vacuum cleaner according to a first embodiment of the invention.

FIG. 1 is a perspective view of a vacuum cleaner 10 in the form of an upright vacuum cleaner according to a first embodiment of the invention. While shown and referred to herein as an upright vacuum cleaner, the vacuum cleaner 10 can alternatively be configured as a hand-held vacuum cleaning device, or as an apparatus having a floor nozzle or a hand-held accessory tool connected to a canister or other portable device by a vacuum hose. Additionally, the vacuum cleaner 10 can be configured to have fluid distribution capability and/or extraction capability.

As illustrated, the vacuum cleaner 10 comprises an upper housing 12 pivotally mounted to a lower base 14. The upper housing 12 generally comprises a main support section 16 for supporting and receiving a collection system 18 for separating and collecting debris from a working airstream for later disposal. In one conventional arrangement illustrated herein, the collection system 18 can include an integrally formed separation/collection module 20 comprising a separator 22 and debris cup 24, with the debris cup 24 provided with a bottom-opening debris door for disposal of the collected debris. The separator 22 can comprise a cyclone separator with a single cyclonic separation stage, or multiple stages. In another conventional arrangement, the collection system 18 can include a cyclone separator for separating debris from a working airstream and a separately removable debris cup for receiving and collecting the separated debris from the cyclone separator. It is understood that other types of collection systems 18 can be used, such as centrifugal separators or bulk separators. In yet another conventional arrangement, the collection system 18 can include a filter bag. The vacuum cleaner 10 can also be provided with one or more additional filters upstream or downstream of the collection system 18.

The upper housing 12 is pivotally mounted to the base 14 for movement between an upright storage position, shown in FIG. 1, and a reclined use position (not shown). The vacuum cleaner 10 can be provided with a detent mechanism, such as a spring or detent pedal (not shown) on the base 14, for selectively releasing the upper housing 12 from the storage position to the use position. The details of such a detent mechanism are known in the art, and will not be discussed in further detail herein.

The upper housing 12 also has an elongated handle 28 extending upwardly from the main support section 16 that is provided with a hand grip 30 at one end that can be used for maneuvering the vacuum cleaner 10 over a surface to be cleaned. A motor cavity 32 is formed at a lower end of the support section 16 and contains a conventional suction source such as a motor/fan assembly (not shown) positioned therein in fluid communication with the collection system 18. The vacuum cleaner 10 can also be provided with one or more additional filters upstream or downstream of motor/fan assembly.

Figure 2:
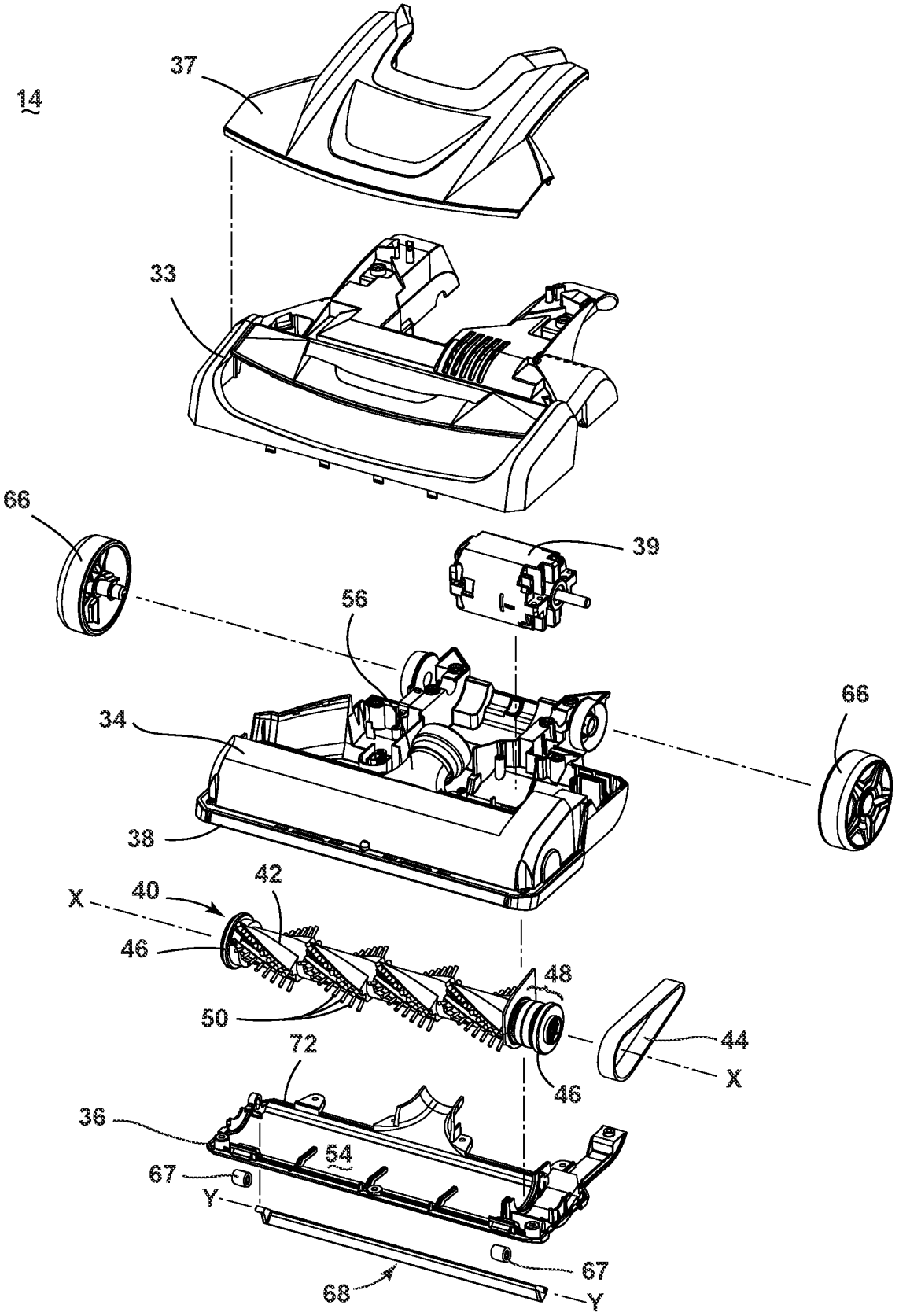
FIG. 2 is a partially exploded view of a base for the vacuum cleaner from FIG. 1.

FIG. 2 is a partially exploded view of the base 14 from FIG. 1. The base 14 includes an upper base housing 33 that couples with a lower base housing 34. A sole plate 36 is mounted to the bottom of the lower base housing 34 to create a partially enclosed space therebetween. A cover 37 mounts to the top of the upper base housing 33. An agitator chamber 38 is provided at a forward portion of the lower base housing 34. As illustrated herein, the sole plate 36 can secure an agitator 40 within the agitator chamber 38. The agitator 40 is positioned within the agitator chamber 38 for rotational movement about an axis X, and can be coupled to and driven by a dedicated agitator motor 39 provided in the base 14 via a commonly known arrangement including a drive belt 44. Alternatively, the agitator 40 can be coupled to the motor/fan assembly in the motor cavity 32 (FIG. 1) The agitator 40 is illustrated as a rotatable brushroll; however, it is within the scope of the invention for other types of agitators to be used, such as dual rotating brushrolls, or vertical axis brushes for example. Moreover, it is within the scope of the invention for the agitator 40 to be mounted within the agitator chamber 38 in a fixed or floating vertical position relative to the chamber 38 and sole plate 36.

The agitator 40 comprises a generally cylindrical brush dowel 42 with a bearing 46 on both ends and a belt engagement surface 48 around the circumference of the dowel 42 near one end that communicates with the belt 44. A plurality of bristle tufts 50 project or extend from the outer circumference of the brush dowel 42. Each bristle tuft 50 can include a plurality of flexible bristles, which may be made from a durable polymer material such as nylon or polyester, for example. The tufts 50 can be arranged in a generally helix pattern in rows along the outer circumference of the brush dowel 42, although other tuft configurations are possible.

A suction nozzle opening 54 is formed in the sole plate 36 and is in fluid communication with the agitator chamber 38. A duct 56 is coupled at one end to the agitator chamber 38 and fluidly communicates the suction nozzle opening 54 with the collection system 18 (FIG. 1). The distal end of the duct 56 is fluidly connected to a vacuum hose 57 (FIG. 1) that forms at least a portion of the working air path between the suction nozzle 54 and the collection system 18 when the separation/collection module 20 is received on the support section 16 as shown in FIG. 1. The hose 57 can be selectively disconnected from fluid communication with the suction nozzle 54 for above-the-floor cleaning. The duct 56 can be formed integrally with the sole plate 36 or lower base housing 34, or a combination thereof. Alternatively, the duct 56 can comprise a separate component that is mounted in the base 14 in fluid communication with the agitator chamber 38 and suction nozzle opening 54.

Figure 3:
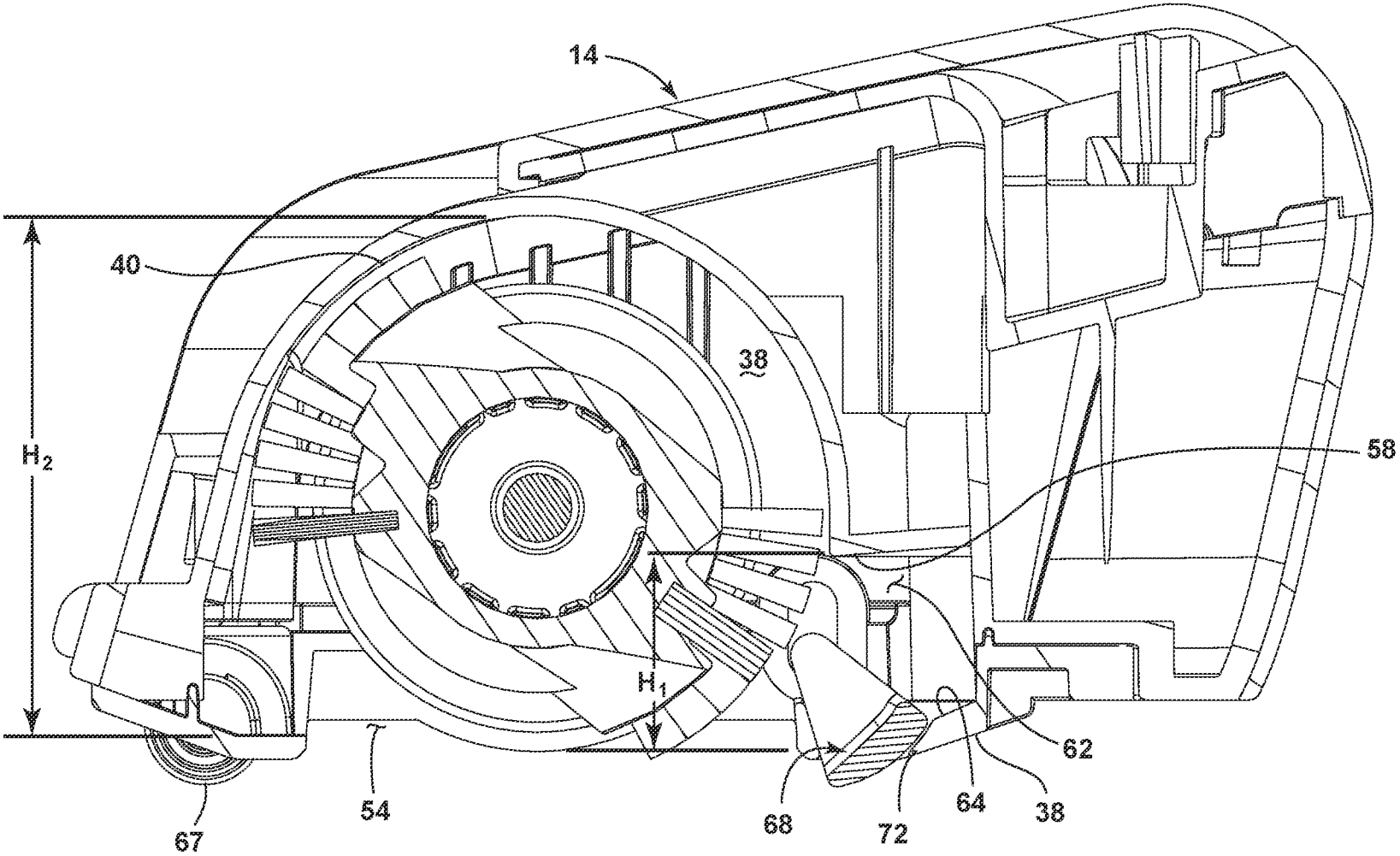
FIG. 3 is a cross-sectional view through line III-III of FIG. 1.
Figure 4:
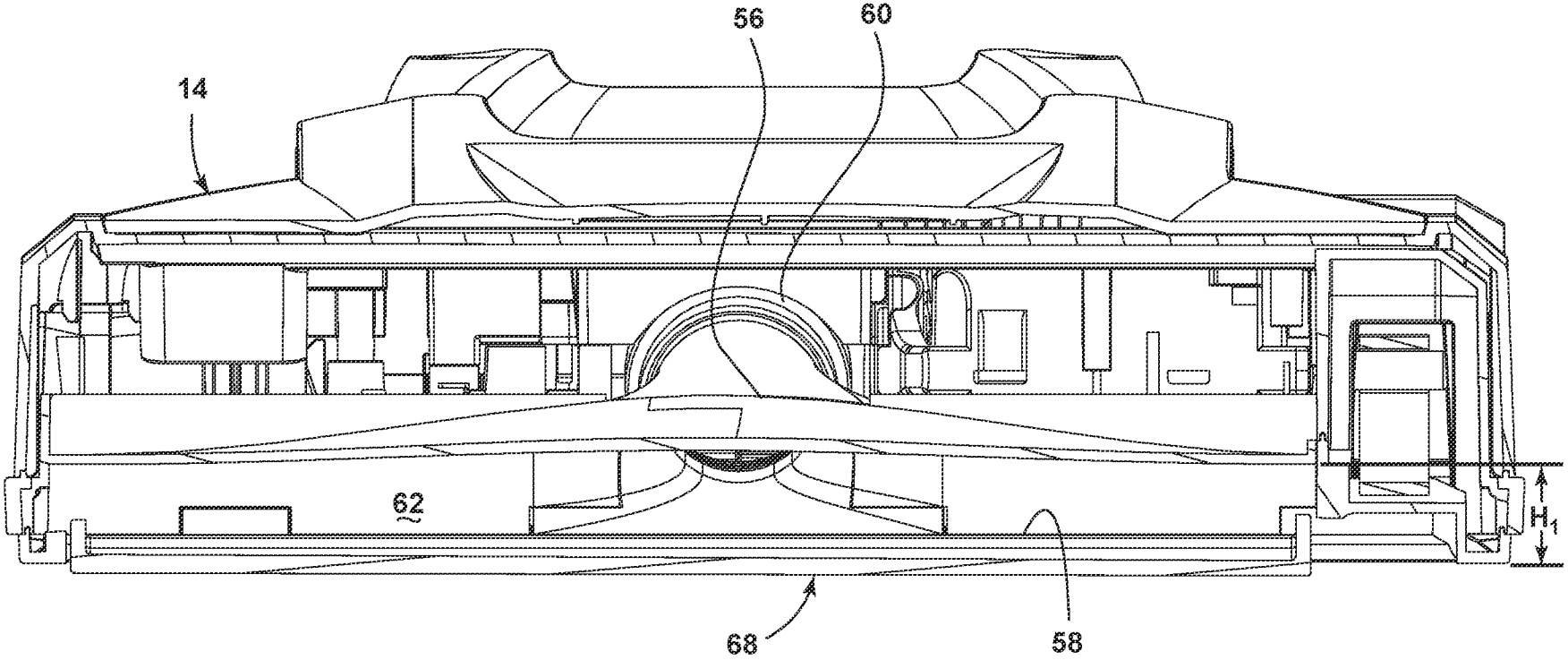
FIG. 4 is a cross-sectional view through line IV-IV of FIG. 1.

As best shown in FIGS. 3-4, the duct 56 is defined by an elongated duct inlet 58 at a forward end, which is formed at a lower rearward portion of the agitator chamber 38 and is in fluid communication with the suction nozzle opening 54. A duct outlet 60 on the distal end is fluidly connected to a downstream portion of the working air path, including the vacuum hose 57, via a flexible conduit (not shown). The duct inlet 58 is defined by a recessed inlet pocket 62 adjoining the lower rear portion of the agitator chamber 38. The height H1 of the duct inlet 58 is defined by the vertical distance between a forward edge of the inlet pocket 62 and a bottom wall 64 of the duct inlet 58, which is formed by a rear portion of the sole plate 36. As shown in FIG. 4, the height H1 is substantially uniform along the entire width of the duct inlet 58 and is less than a height H2 of the agitator chamber 38, which is defined as the vertical distance between the top of the agitator chamber 38 and the bottom wall 64 of the duct inlet 58. In the illustrated embodiment, the height H1 of the duct inlet 58 is less than half the height H2 of the agitator chamber 38.

The reduced height H1 of the duct inlet 58 relative to the height H2 of the agitator chamber 38 restricts or chokes off the working air that flows through the duct inlet 58 so that the working air is evenly distributed across the entire width of the duct inlet 58. The reduced height H1 can also increase the velocity of working air flowing along the entire width of the duct inlet 58 as well as the outward portions of the agitator housing 38, which can enhance entrainment and ingestion of debris and can reduce potential for re-entrainment of debris within the agitator chamber 38.

Referring to FIG. 2, a pair of rear wheels 66 is provided on the lower base housing 34 for maneuvering the vacuum cleaner 10 over a surface to be cleaned. A pair of front wheels 67 can be provided on a forward portion of the sole plate 36 for rollably supporting the lower base 14 on the surface to be cleaned. In another variation, the base 14 can include an optional suction nozzle height adjustment mechanism (not shown) comprising a rotatable carriage attached to the upper base housing 33 on which a pair of carriage wheels are mounted for maneuvering the vacuum cleaner 10 over a surface to be cleaned. Additionally, a rotatable knob for actuating the adjustment mechanism can be provided on the exterior of the base 14.

In operation, the vacuum cleaner 10 draws in debris-laden working air through the suction nozzle opening 54, agitator chamber 38 and through the duct 56. The duct 56 funnels the working air flowing from the agitator chamber 38 through the reduced height H1 of the duct inlet 58 and evenly distributes the working air across the entire width of the duct inlet 58. The air flows through the duct 56 in the base 14 and into the downstream collection system 18 where the debris is substantially separated from the working air. The air flow then passes through the motor cavity 32 and past the suction source prior to being exhausted from the vacuum cleaner 10. The collection system 18 can be periodically emptied of debris.

Referring to FIG. 2-3, the vacuum cleaner 10 further comprises a blade assembly 68 that is provided on the base 14, adjacent to a rear edge 72 of the suction nozzle opening 54 and rearwardly of the agitator 40, below the duct inlet 58, for collecting debris. The blade assembly 68 functions to guide debris D toward the duct 56 (FIG. 2). The blade assembly 68 is pivotally coupled to the sole plate 36 of the base 14 for movement about a pivot axis Y which is parallel to, but spaced from, the brushroll axis, X. While shown herein as being pivotally mounted to the sole plate 36, the blade assembly 68 can alternatively be pivotally mounted elsewhere on the base 14, such as on the upper base housing 33 or the lower base housing 34.

Figure 5:
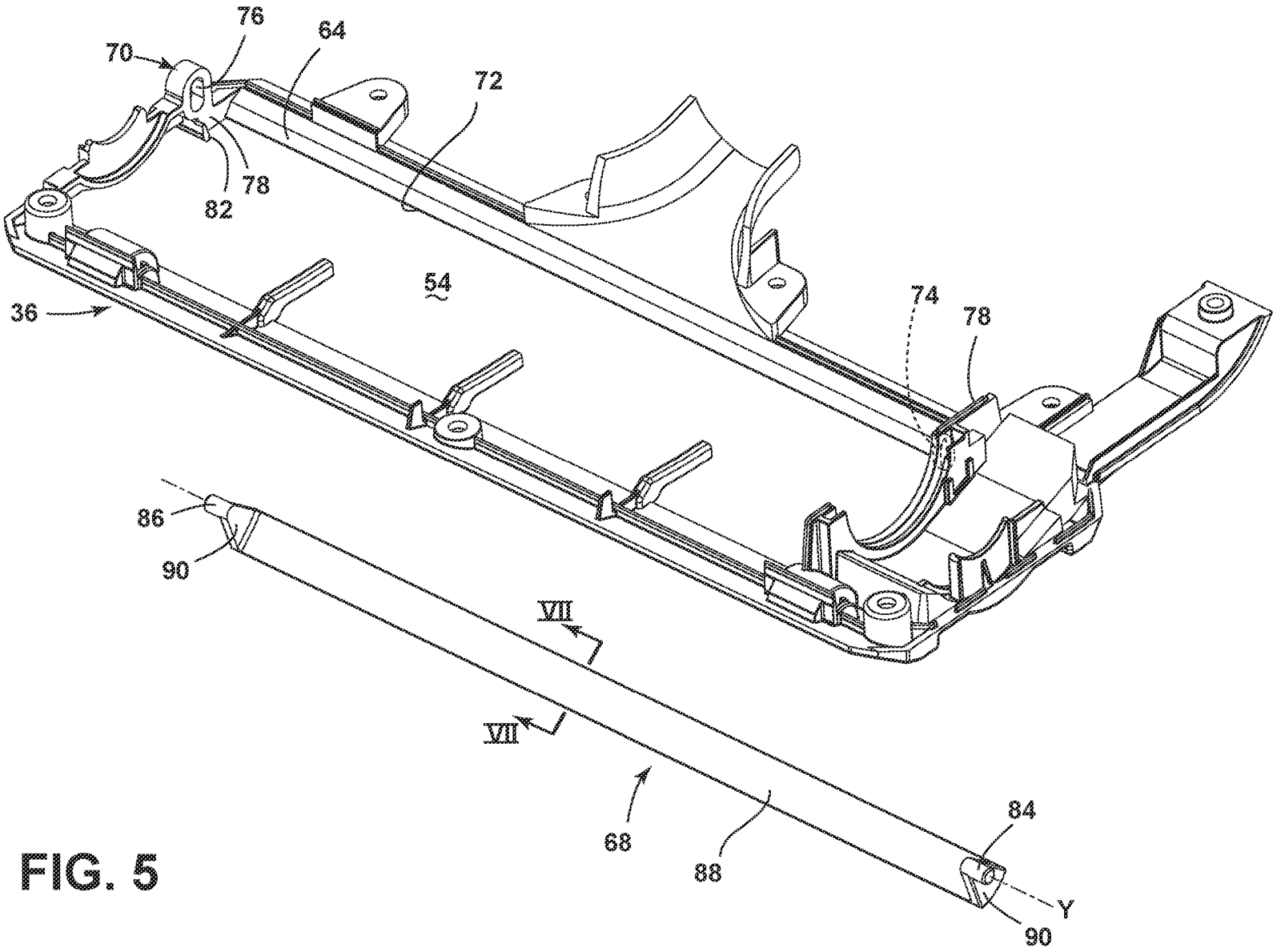
FIG. 5 is an exploded view of a sole plate and debris collecting blade of the base from FIG. 2.

Referring to FIGS. 4-5, the blade assembly 68 can extend across the entire width of the suction nozzle opening 54 and is coupled to the sole plate 36 via a multiply-adjustable coupling member 70 provided on the sole plate 36 that allows the blade assembly 68 to swing about the pivot axis Y as well as to float vertically relative to the sole plate 36, thereby floating vertically relative to a surface to be cleaned. The pivotally mounted, floating blade assembly 68 is configured to swing about axis Y and float vertically relative to the surface to collect debris on a forward stroke and prevent debris from being scattered past the sole plate 36 by the agitator 40. Additionally, the blade assembly 68 and flexible coupling member 70 are configured to prevent the blade assembly 68 from plowing debris on a rearward stroke. The blade assembly 68 can comprise a thermoplastic material such as acrylonitrile butadiene styrene (ABS) or acetal (also known as polyoxymethylene) for example.

Figure 6:
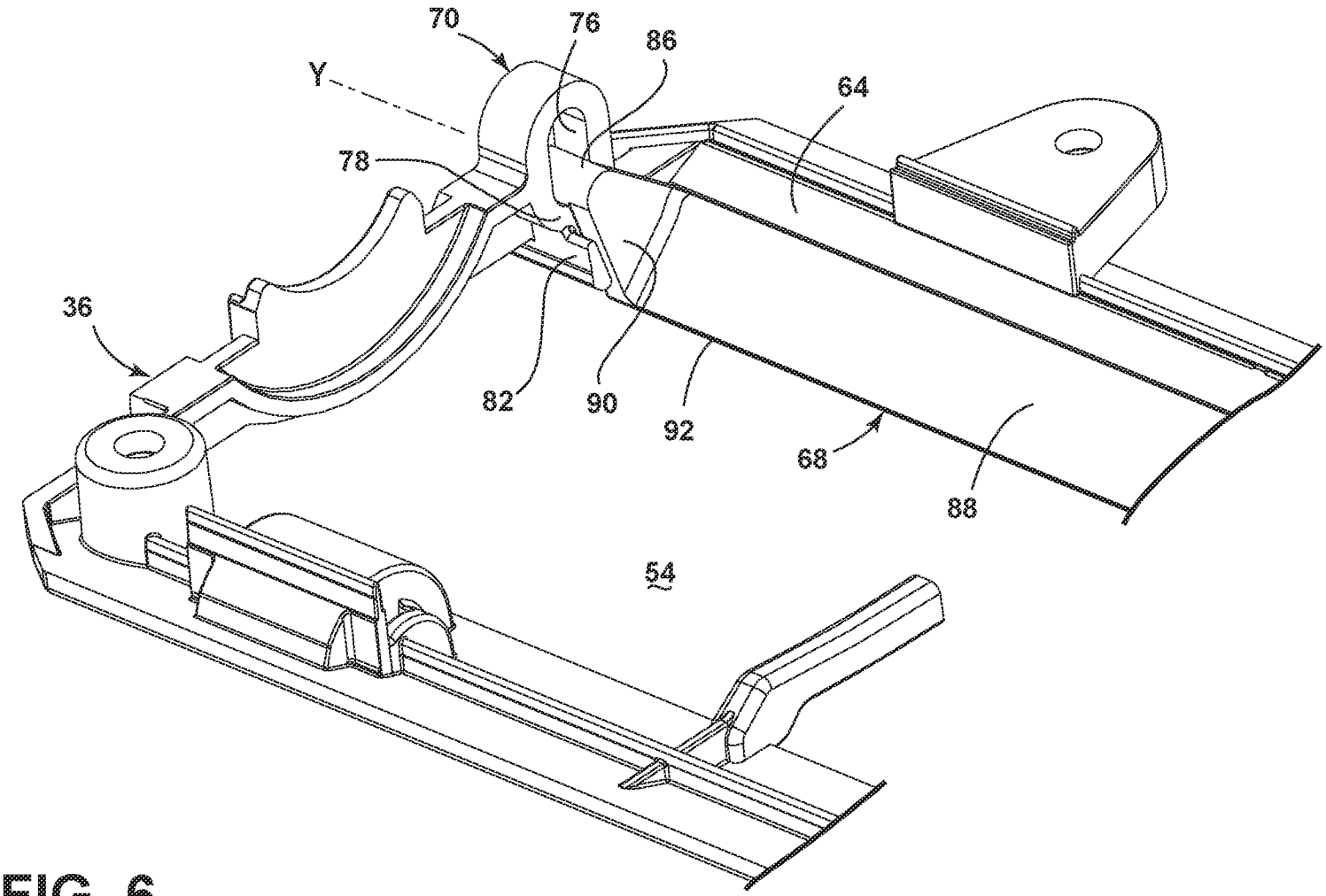
FIG. 6 is a close up view showing coupling details between the sole plate and debris collecting blade of the base from FIG. 2.

As best shown in FIGS. 5 and 6, the flexible coupling member 70 comprises left and right mounting tracks 74, 76 provided on opposed inner walls 78 of the sole plate 36. While only the right mounting track 76 is clearly shown in FIG. 5-6, the left mounting track 74 is substantially similar. The left and right mounting tracks 74, 76 are defined by vertical slotted holes that are positioned adjacent to the rear edge 72 of the suction nozzle opening 54. A stop tab 82 is positioned on each inner wall 78 forwardly of the corresponding mounting track 74, 76 to limit the forward pivot position of the blade assembly 68.

The blade assembly 68 includes a left and right pivot pin 84, 86 that protrude outwardly along blade axis Y. The left and right pivot pins 84, 86 are configured to be pivotally mounted within the corresponding left and right mounting track 74, 76 so that the blade assembly 68 can pivot about axis Y. The length of the mounting tracks 74, 76 are greater than the diameter of the pivot pins 84, 86, allowing the pivot pins 84, 86 to also slide vertically within the mounting tracks 74, 76. Thus, the blade assembly 68 can automatically adjust vertically to maintain contact with the surface to be cleaned regardless of height variations between the base 14 and the surface to be cleaned. Such height variations can arise from different surface types, such as carpets with different pile heights or hard floor surfaces, for example, or from different nozzle height settings if the vacuum cleaner 10 incorporates a height adjustment mechanism. For example, the blade assembly 68 can slide downwardly in the mounting tracks 74, 76 to maintain contact with the surface to be cleaned when the vacuum cleaner 10 is used on lower pile height carpets or hard floor surfaces, or elevated nozzle height settings. Conversely, the blade assembly 68 can slide upwardly in the mounting tracks 74, 76 to accommodate higher pile height carpets or lower nozzle height settings.

In the illustrated embodiment, the blade assembly 68 comprises an elongated scoop 88 that scoops up debris on a forward stroke of the vacuum cleaner 10 and glides over the surface to be cleaned on a rearward stroke of the vacuum cleaner 10. The blade assembly 68 further includes a pair of support ends 90 formed integrally with and extending from the ends of the scoop 88. The support ends 90 comprise triangular-shaped plates and the scoop 88 is connected to a lower portion of each support end 90. The left and right pivot pins 84, 86 protrude outwardly from an upper portion of each support end 90 along blade axis Y.

Figure 7:
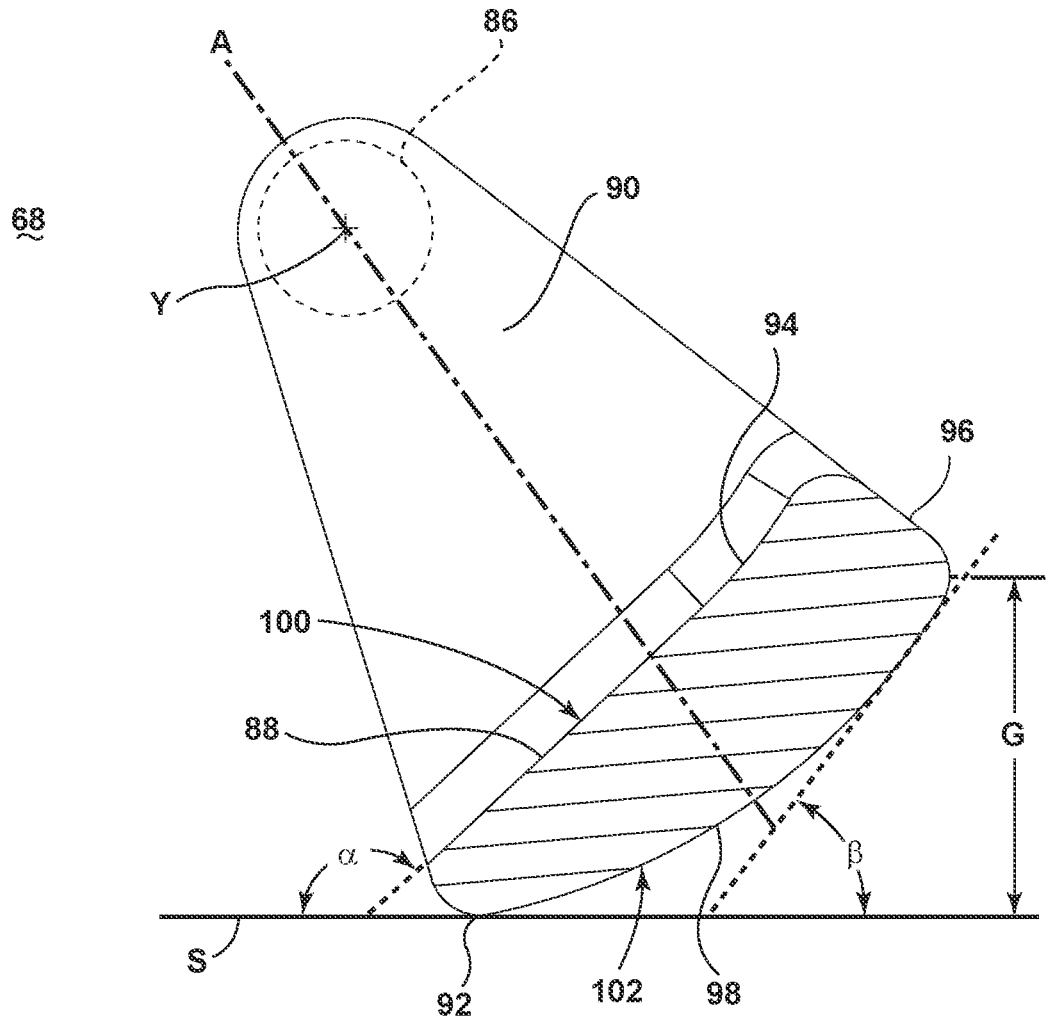
FIG. 7 is a cross-sectional view through line VII-VII of the debris collecting blade from FIG. 5.

FIG. 7 is a section view of the blade assembly 68 showing the scoop 88, which is defined by an adjoining front edge 92, an upper surface 94, a rear wall 96, and a lower surface 98. The scoop 88 is offset from the pivot axis Y and is not radial to the axis Y. Instead, the scoop 88 is oriented orthogonal to a plane A, which intersects axis Y as illustrated in FIG. 7. Thus, the scoop 88 is configured to swing or rotate about the pivot axis Y as the blade assembly 68 pivots about the pivot pins 84, 86. The front edge 92 of the scoop 88 is rounded to prevent snagging so the scoop 88 drags smoothly across the surface to be cleaned S. The thickness of the scoop 88 gradually increases from the front edge 92 to the rear wall 96. The front edge 92 is thinner than the rear wall 96 to facilitate collecting and guiding debris up the scoop 88 and into the suction nozzle opening 54 (see FIG. 3). In the illustrated embodiment, the upper surface 94 is defined by a concave ramp 100 that extends upwardly from the front edge 92 to the rear wall 96 for guiding debris into the suction nozzle opening 54 and duct inlet 58 during use.

Conversely, the lower surface 98 is defined by a convex glide 102 that extends from the front edge 92 to the bottom of the rear wall 96 for gliding the blade assembly 68 across the surface to be cleaned and for riding up and floating the blade assembly 68 over debris on a rearward cleaning stroke. The junction between the glide 102 and the rear wall 96 is also rounded to prevent plowing debris and to prevent catching or snagging the surface to be cleaned.

Referring to FIGS. 6 and 7, although the blade assembly 68 is free to pivot rearwardly away from the stop tabs 82 when the vacuum cleaner 10 is pushed forward, the stop tabs 82 are configured to contact the front edges of the support ends 90 to limit the forward rotational position of the blade assembly 68. This configuration ensures that the front edge 92 is offset rearwardly relative to axis Y so that the scoop 88 is always inclined relative to the surface to be cleaned S at a minimum scoop approach angle $\alpha$. The minimum scoop approach angle $\alpha$ is the angle defined between the upper surface 94 and the surface to be cleaned S forward of the front edge 92. The minimum scoop approach angle $\alpha$ comprises an obtuse angle greater than 90 degrees and less than 180 degrees for guiding debris up the ramp 100 and into the suction nozzle opening 54. Maintaining a minimum scoop approach angle $\alpha$ within the specified range ensures that the front edge 92 will engage the surface S and support the weight of the blade assembly 68 on a forward cleaning stroke, which increases engagement between the scoop 88 and the surface S, and thus enhances debris pickup as the blade assembly 68 is dragged across the surface S during use.

On a rearward cleaning stroke, the blade assembly 68 can pivot forwardly and transition from a first position where the blade assembly 68 is supported on the front edge 92 to a second position where the blade assembly 68 is supported on the glide 102. However, the stop tabs 82 limit the forward blade position to maintain a minimum glide approach angle $\beta$ which is defined as the angle between the glide 102 and the surface to be cleaned S on a rearward cleaning stroke. The glide approach angle $\beta$ comprises an acute angle greater than 0 degrees and less than 90 degrees so that the lower surface 98 of the scoop 88 is inclined relative to the surface S so the glide 102 can ride up and float over large dirt particles or debris located rearwardly of the blade assembly 68. The glide approach angle $\beta$ further defines a gap G between the bottom of the rear wall 96 and the surface to be cleaned S. The gap G provides clearance for the rear wall 96 to slide over large debris on a rearward cleaning stroke. Upon passing through the gap G the large debris can contact the glide 102 and wedge against the lower surface 98 of the blade assembly 68, which forces the blade assembly 68 to float upwardly in the flexible coupling 70 so it can pass over large debris D which can then be ingested through the suction nozzle opening 54. When the debris D clears the front edge 92, the blade assembly 68 slides downwardly in the flexible coupling 70 and the glide 102 returns into contact with the surface S and glides along the surface S. Thus, the blade assembly 68 is configured to slide up and float over debris D on the surface S on a rearward cleaning stroke so that the debris D can be ingested through the suction nozzle opening 54 rather than getting plowed rearwardly by the scoop 88.

In operation, the blade assembly 68 automatically adjusts to the surface to be cleaned S by sliding vertically within the flexible coupling member 70. FIG. 8A shows the base 14 on the surface to be cleaned S and being pushed in a forward stroke F. The surface S has been illustrated as a relatively low pile height carpet. If the base 14 is moved from a higher pile carpet onto surface S the blade assembly 68 can float downwardly via the flexible coupling member 70 until the scoop 88 contacts the surface to be cleaned S as shown in FIG. 8A. If the base 14 is moved from a bare floor surface onto surface S, the blade assembly 68 can automatically slide upwardly in the flexible coupling member 70 to accommodate the height difference between the floor surfaces.

As the base 14 is pushed in a forward stroke, F, friction between the lower surface 98 of the scoop 88 and the surface to be cleaned S pivots the blade assembly 68 rearwardly, in a counterclockwise direction about axis Y. The scoop 88 swings counterclockwise about axis Y until the front edge 92 digs into the surface, S, and drags across the surface to be cleaned, S. At the same time, the agitator 40 rotates forwardly (e.g. counterclockwise as shown in FIG. 8A) about the brushroll axis X to loosen debris D from the surface S. The agitator 40 lifts and propels debris D rearwardly. Some of the debris D can be flung rearwardly by the agitator 40 and can be collected or blocked by the scoop 88 and prevented from scattering past the suction nozzle opening 54. The momentum of the propelled debris D can carry the debris D onto the ramp 100. The ramp 100 guides debris up the scoop 88 and through the duct 56.

Figure 8B:
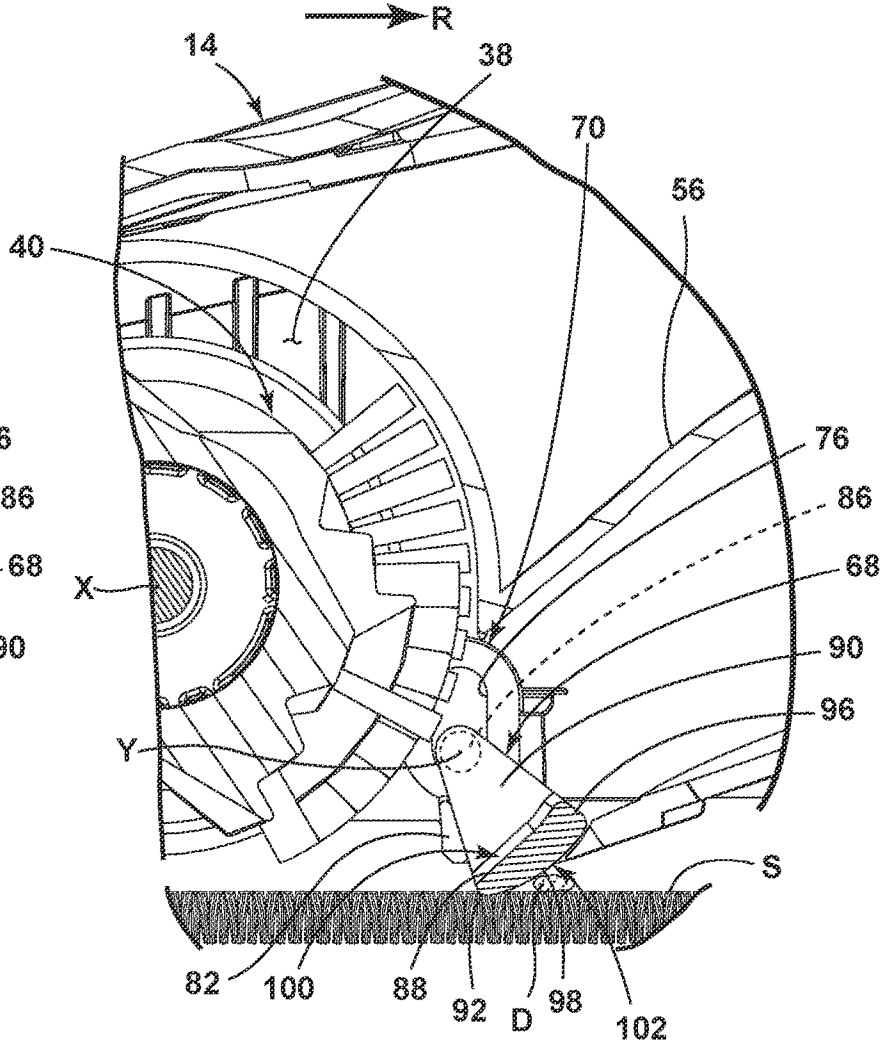
FIGS. 8B-8C are cross-sectional views through line VIII-VIII of FIG. 1 illustrating the base assembly in a rearward stroke with the debris collecting blade in an upward position to float over debris on the surface to be cleaned.
Figure 8A:
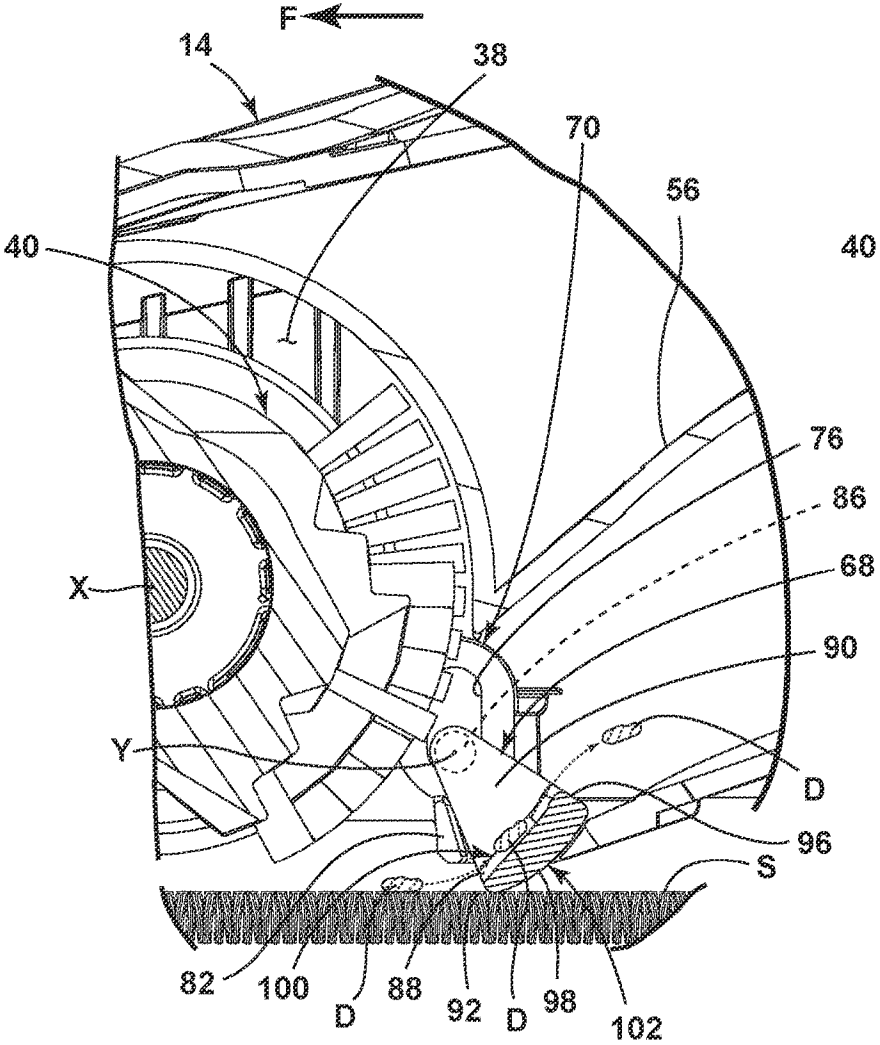
FIG. 8A is a cross-sectional view through line VIII-VIII of FIG. 1 illustrating the base assembly in a forward stroke with the debris collecting blade in a downward position contacting the surface to be cleaned.
Figure 8C:
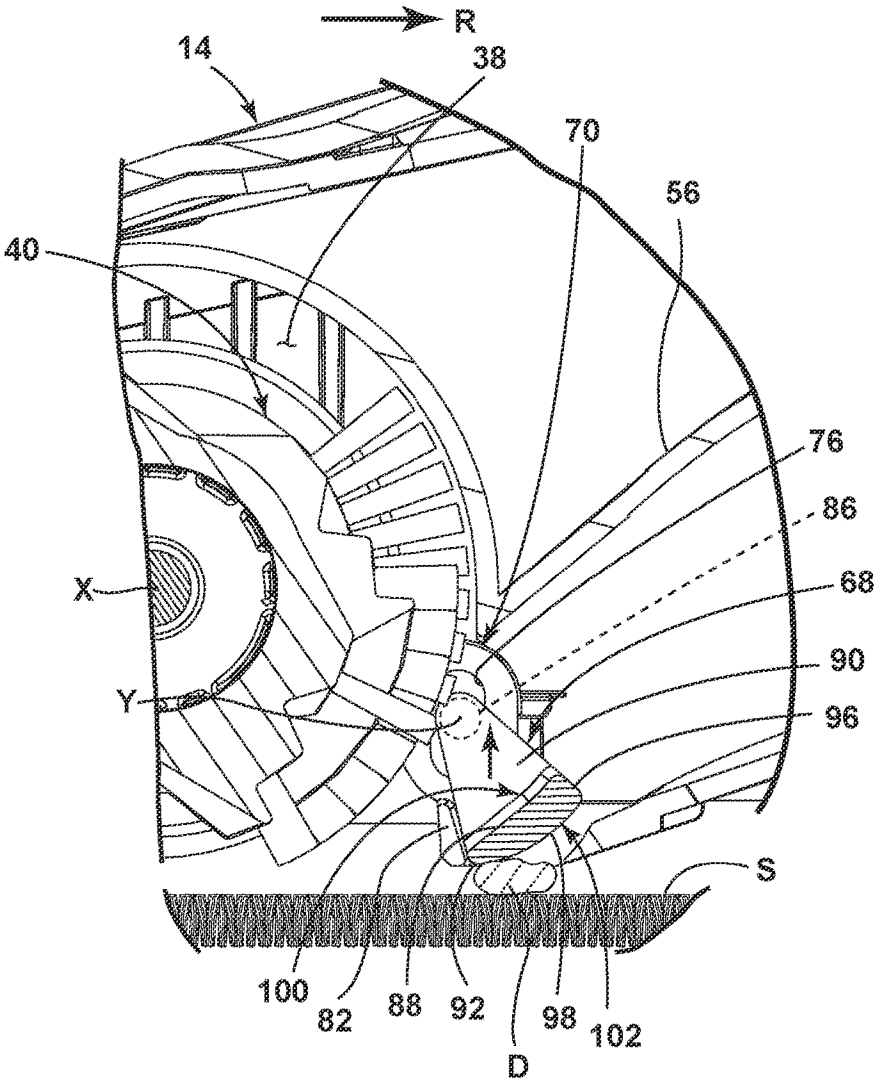

FIGS. 8B-8C show the base 14 on the surface to be cleaned S and being pushed in a rearward stroke R. On the rearward stroke R, the blade assembly 68 is configured to prevent plowing debris, D, and instead floats over the debris D so the debris D can be ingested through the suction nozzle opening 54. At the initiation of the rearward stroke R the blade assembly 68 transitions from the first position shown in FIG. 8A, where the front edge 92 is in contact with surface S, to a second position shown in FIG. 8B, where the glide 102 is in contact with the surface S. As the base 14 is moved rearwardly, friction between the lower surface 98 of the scoop 88 and the surface to be cleaned S pivots the blade assembly 68 forwardly in a clockwise direction. The scoop 88 swings clockwise about axis Y off of the front edge 92 onto the glide 102, which supports and slides the blade assembly 68 across the surface S during the rearward stroke R. The blade assembly 68 continues to pivot clockwise until the support ends 90 contact the stop tabs 82, which limit the clockwise rotation of the blade assembly 68 and maintain a minimum glide approach angle β and gap G.

When the blade assembly 68 encounters debris D, the blade assembly 68 transitions to a third position raised above surface S, shown in FIG. 8C. When the blade assembly 68 encounters debris D on a rearward stroke, the debris D passes under the rear wall 96 and contacts the glide 102, which is inclined relative to surface S. The inclined, convex surface of the glide 102 slides up and over the debris D which lifts the blade assembly 68 off surface S and forces the blade assembly 68 to float upwardly in the flexible coupling 70. As the base 14 continues to move rearwardly, the front edge 92 clears the debris D and the blade assembly 68 slides downwardly in the multiply-adjustable coupling 70 and returns to the second position with the glide 102 in contact and sliding along the surface S, as shown in FIG. 8B. The debris D cleared by the blade assembly 68 is then located forwardly of the blade assembly 68, and can be ingested through suction nozzle opening 54, duct inlet 58 and downstream collection system 18.

The flexible coupling members 70 may further comprise a biasing device (not shown) configured to urge the blade assembly 68 vertically downward such that the front edge 92 maintains consistent contact with the surface to be cleaned on a forward stroke. This may be achieved by adding springs or weights to the flexible coupling member 70 in register with the left and right pivot pins 84, 86 to urge the left and right pivot pins 84, 86 downwardly within the mounting tracks 74, 76, thus forcing the front edge 92 downwardly.

Figure 9A:
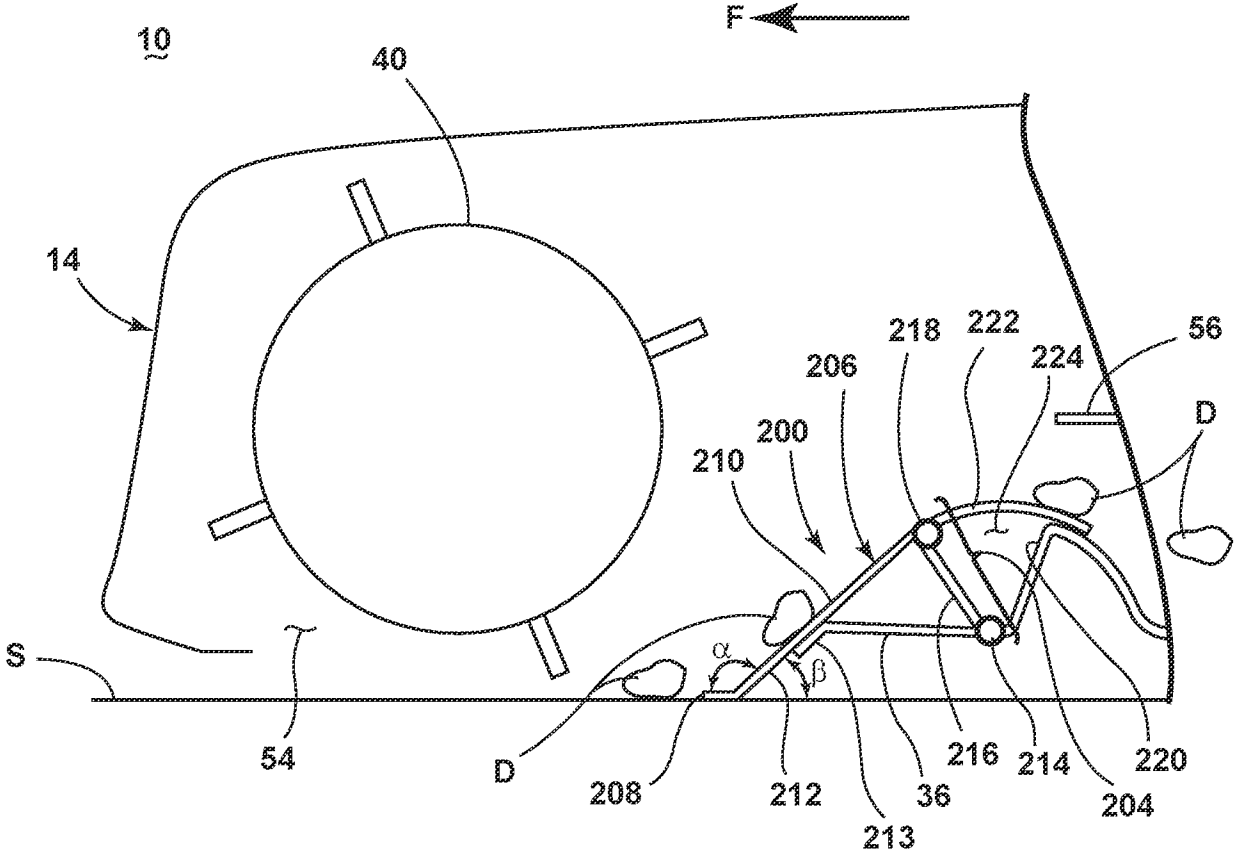
FIG. 9A is a schematic view of a vacuum cleaner having a debris collection blade according to a second embodiment of the invention and showing the blade in a downward position contacting the surface to be cleaned on a forward cleaning stroke.
Figure 9B:
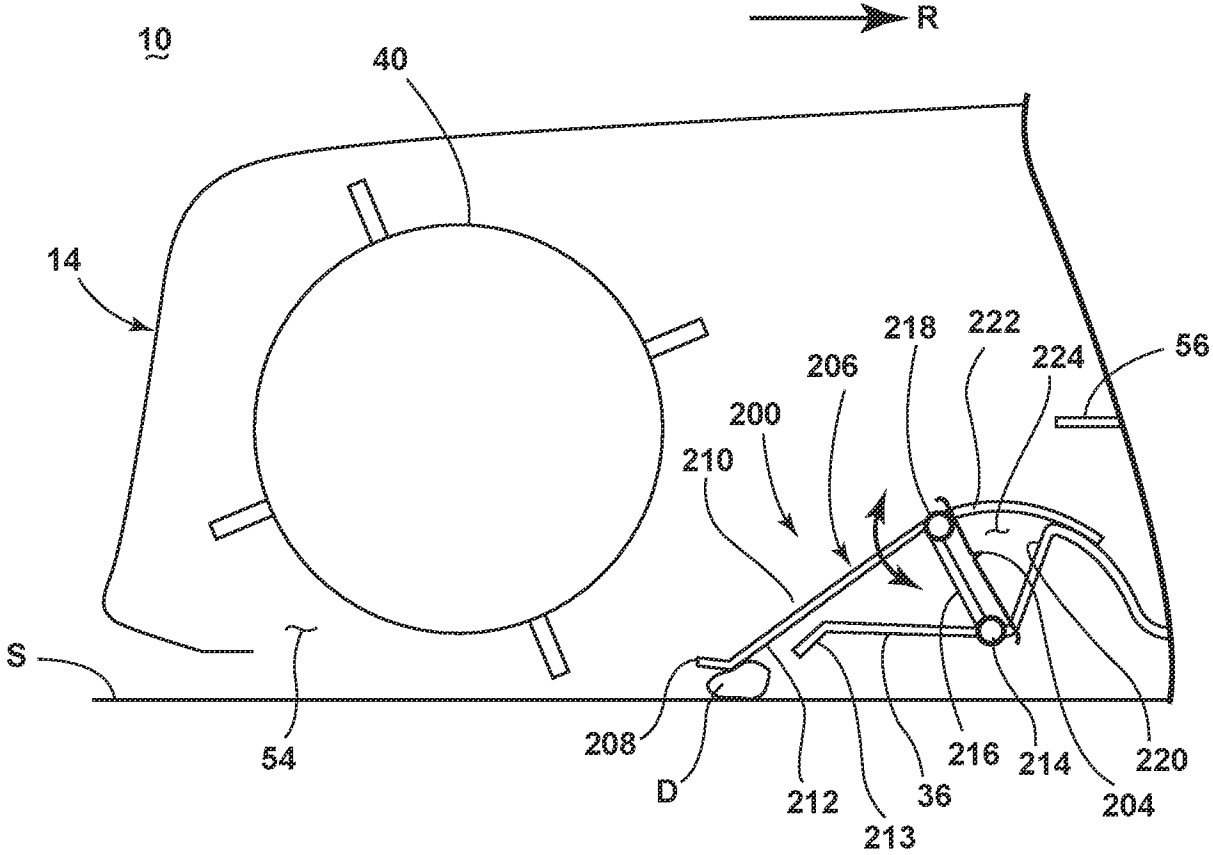
FIG. 9B is a schematic view similar to FIG. 9A, showing the blade in an upward position raised off the surface to be cleaned and floating over debris on a rearward cleaning stroke.
Figure 9C:
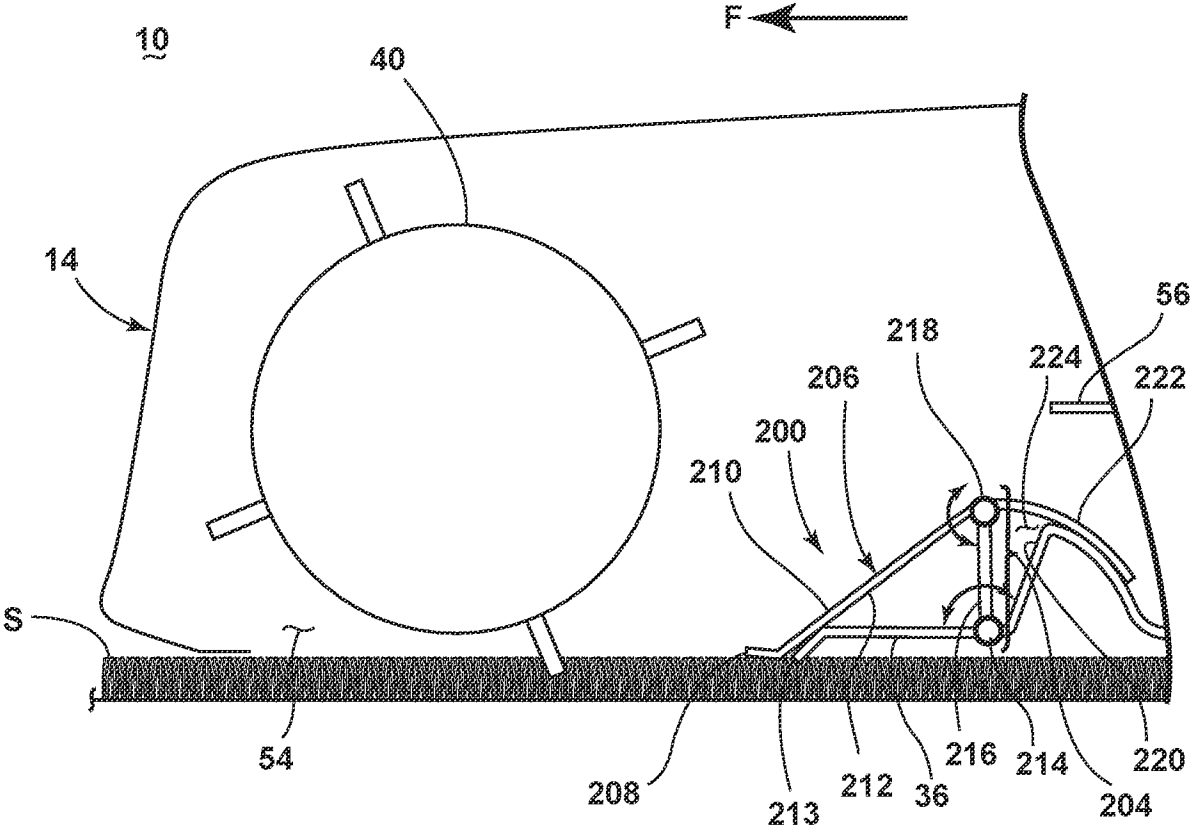
FIG. 9C is a schematic view similar to FIG. 9A, showing the blade in a retracted position.

FIGS. 9A-9C are schematic views of a vacuum cleaner 10 having a blade assembly 200 according to a second embodiment of the invention. The second embodiment of the blade assembly 200 can be used with the vacuum cleaner 10 shown in FIGS. 1-8 in place of the first embodiment of the blade assembly 68. The second embodiment of the blade assembly 200 is substantially similar to the first embodiment, except that the blade assembly 200 is coupled to the base 14 by a linkage assembly 204 instead of a floating pivot multiply-adjustable coupling 70 as in the first embodiment. Additionally, the blade assembly 200 of the second embodiment comprises a scoop 206 that is substantially planar instead of arcuate as compared to the scoop 88 described in the first embodiment.

The scoop 206 is defined by a front edge 208, an adjoining ramp 210, which is defined by an elongate forward facing planar surface, and a glide 212, which is defined by the backside of the ramp 210. Like the blade assembly 68, the ramp 210 functions to guide debris D toward the duct 56. A portion of the back of the scoop 206 rests on a support 213, which can be formed by a rear edge of the suction nozzle opening 54 in the sole plate 36. The support 213 maintains the ramp 210 at a minimum scoop approach angle α and glide approach angle β with respect to the surface to be cleaned S, as previously described.

The linkage assembly 204 comprises a first pivot 214 formed on a first end of a link arm 216, which is pivotally mounted to a mating projection (not shown) on a top portion of the support 213. A second pivot 218 is formed on the opposite end of the link arm 216 and pivotally couples the link arm 216 to the scoop 206. The scoop 206 is configured to pivot about the second pivot 218 and can also articulate relative to the first pivot 214 when the link arm 216 rotates about the first pivot 214, which moves the interconnected second pivot 218 forwardly or rearwardly about the first pivot 214. Thus, the blade assembly 200 is automatically multiply-adjustable relative to the base 14 and nozzle opening 54. Although the schematic figure shows a single link arm 216, it is contemplated that the linkage assembly 204 can comprise a link arm 216 mounted at each end of the scoop 206, for example, or a plurality of link arms 216 mounted along the length of the scoop 206 in a configuration similar to a piano hinge, for example.

The support 213 limits the rotation of the scoop 206 about the second pivot 218 in a counterclockwise direction; however, the scoop 206 is free to rotate away from the support 213 in a clockwise direction about the second pivot 218. The scoop 206 can rotate about the second pivot 218 between a downward position, shown in FIG. 9A in which the front edge 208 drags along the surface to be cleaned S and an upward position, shown in FIG. 9B, in which the scoop 206 is raised off the surface S, as will be described in greater detail below.

The scoop 206 is also configured to float vertically relative to the base 14 and the surface to be cleaned S about the first pivot 214, which has been illustrated as being formed on an upper surface of the support 213, rearwardly of the suction nozzle opening 54. The link arm 216 is configured to rotate counterclockwise/forwardly and clockwise/rearwardly about the first pivot 214 to lower and raise the scoop 206 relative to the cleaning surface S to accommodate various cleaning surfaces or nozzle height settings. For example, if the vacuum cleaner 10 is placed on low pile carpet, a hard floor surface, or set at an elevated nozzle height setting, the link arm 216 can rotate counterclockwise/forwardly about the first pivot 214 to articulate the second pivot 218 and lower the scoop 206 into contact with the surface S, as shown in FIG. 9A. Conversely, if the cleaner 10 is placed on high pile carpet or set at a lowered nozzle height setting, the link arm 216 can rotate rearwardly about the first pivot 214 to articulate the second pivot 218 and raise the scoop 206 for accommodating the higher pile carpet, as shown in FIG. 9C. The rearward position of the link arm 216 is limited by a stop 220 formed on the sole plate 36.

The scoop 206 also comprises a shield portion 222. As illustrated, the shield portion 222 comprises an arcuate wall extending rearwardly from the ramp 210. The shield portion 222 can be an essentially continuous extension of the ramp 210, such that the shield portion 222 also acts to guide debris toward the duct 56. However, the ramp 210 and shield portion 222 are hingedly connected about the second pivot 218 so that the ramp 210 can pivot relative to the shield portion 222 about the second pivot 218. The shield portion 222 is configured to slide over the top of the stop 220 to accommodate for changes in the position of the link arm 216 and is configured to block debris from falling into an opening 224 between the link arm 216 and the stop 220 when the link arm 216 is rotated away from the stop 220.

In operation, the blade assembly 200 automatically adjusts to the surface to be cleaned S via the multiply-adjustable coupling defined by the linkage assembly 204, which hingedly couples the blade assembly 200 to the lower base 14 and permits compound adjustment for collecting debris on a forward stroke and preventing debris from being scattered past the sole plate 36 by the agitator 40. Additionally, the configuration of the blade assembly 200 and linkage assembly 204 prevent plowing debris on a rearward stroke. When the base 14 is placed on the surface to be cleaned S the scoop 206 can float vertically upwardly or downwardly relative to the surface S by pivoting about the first pivot 214 or articulating about the second pivot 218 on the link arm 216.

On a forward stroke F, as shown in FIG. 9A, the scoop 206 pivots so that the front edge 208 drags along the surface to be cleaned S to prevent debris from being scattered past the sole plate 36 by the agitator 40. Instead, debris loosened by the agitator 40 is guided up the ramp 210, entrained in the working air flow and transported through the working air path to the downstream collection system 18.

The blade assembly 200 is also configured to prevent plowing debris on a rearward stroke R. As shown in FIG. 9B, when the scoop 206 encounters debris D on a rearward stroke R, the glide 212 slides up and over the debris and pivots the scoop 206 upwardly about the second pivot 218. When the front edge 208 clears the debris D the scoop 206 pivots downwardly about the second pivot 218, and returns the front edge 208 into contact with the cleaning surface to prevent debris from being scattered past the sole plate 36 by the agitator 40.

The vacuum cleaner disclosed herein includes an improved suction nozzle configuration. An advantage that may be realized in the practice of some embodiments of the described vacuum cleaner is that debris is prevented from being scattered past the suction nozzle opening by the agitator and debris is prevented from being plowed on a rearward cleaning stroke. The blade assembly, which is coupled to the lower base 14 through a multiply-adjustable coupling, is configured to collect and guide debris D through the suction nozzle opening 54 and downstream collection system instead of allowing the debris to scatter past the nozzle opening and avoid ingestion as in prior art designs. Moreover, the multiply-adjustable coupling permits the blade assembly to slide up and float over debris on a rearward cleaning stroke so that the debris can be ingested through the suction nozzle opening rather than plowing or pushing debris away from the opening as in prior art designs. In addition, the multiply-adjustably coupled blade assembly is configured to automatically adjust to accommodate cleaning surfaces of various heights and different nozzle height settings.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a housing including a base;

a sole plate removably mounted to a bottom of the housing, the sole plate at least partially defining a suction nozzle opening forming an inlet of the base;

an agitator chamber fluidly coupled to the suction nozzle opening and at least partially defined by the housing and the sole plate, the agitator chamber housing an agitator;

a suction source in fluid communication with the suction nozzle opening and adapted for generating a working airstream along a working air path;

a wiper adjustably mounted to the sole plate and extending rearwardly within the suction nozzle opening, the wiper comprising a unitary body at least selectively adapted to contact a surface to be cleaned;

a multiply-adjustable coupling provided on the sole plate, the multiply-adjustable coupling forming a connection between the wiper and the sole plate, the multiply-adjustable coupling having opposing inwardly facing walls provided on opposite sides of the sole plate, with the wiper extending between the opposing inwardly facing walls, the multiply-adjustable coupling configured to provide for vertical movement of the wiper relative to the surface to be cleaned and for pivotal movement of the wiper relative to the sole plate; and a working air duct forming at least a portion of the working air path from the suction nozzle opening to the suction source, the working air duct provided with the base, the working air duct defining aa portion of the working air path with a reduced size.

2. The vacuum cleaner of claim 1 wherein the working air duct is coupled to the agitator chamber and fluidly communicates the suction nozzle opening with a collection system there through.

3. The vacuum cleaner of claim 2 wherein the working air duct is integrally formed with the base.

4. The vacuum cleaner of claim 2 wherein the working air duct comprises an elongated duct inlet adjacent the agitator chamber.

5. The vacuum cleaner of claim 4 wherein the elongated duct inlet is defined by a recessed inlet pocket adjoining a lower rear portion of the agitator chamber, wherein the recessed inlet pocket at least partially forms the elongated duct inlet at a forward end of the working air duct.

6. The vacuum cleaner of claim 5 wherein a height of the elongated duct inlet is defined by a vertical distance between an upper forward edge of the recessed inlet pocket and a bottom wall of the elongated duct inlet.

7. The vacuum cleaner of claim 6 wherein the bottom wall of the elongated duct inlet is formed by a portion of the sole plate.

8. The vacuum cleaner of claim 5 wherein a height of the elongated duct inlet is substantially uniform from a first end to a second end along an entire width of the elongated duct inlet.

9. The vacuum cleaner of claim 8 wherein the height of the elongated duct inlet is less than an agitator chamber height.

10. The vacuum cleaner of claim 9 wherein the agitator chamber height is defined as a vertical distance between a top of the agitator chamber and a bottom wall of the elongated duct inlet.

11. The vacuum cleaner of claim 9 wherein the height of the elongated duct inlet is less than half of the agitator chamber height.

12. The vacuum cleaner of claim 1 wherein the working air duct is mounted in the base, and suction nozzle opening defines a reduced height compared to an agitator chamber height.

13. The vacuum cleaner of claim 12 wherein the agitator comprises a rotating brushroll.

14. The vacuum cleaner of claim 12, wherein the reduced height is provided at the inlet of the suction nozzle opening.

15. The vacuum cleaner of claim 12, wherein the reduced height is uniform along an extent of the suction nozzle opening.

16. The vacuum cleaner of claim 12, wherein the reduced height is less than half the agitator chamber height.

17. The vacuum cleaner of claim 1 wherein the wiper extends an entire length of the suction nozzle opening.

18. The vacuum cleaner of claim 1 wherein the wiper comprises a debris collection blade operably coupled to the base via the multiply-adjustable coupling.

19. The vacuum cleaner of claim 1, wherein the multiple adjustable coupling is statically mounted to the sole plate.

20. A vacuum cleaner, comprising:

a housing including a base, the housing at least partially defining an agitator chamber therein;

a sole plate removably mounted to a bottom of the housing, the sole plate at least partially defining a suction nozzle opening forming an inlet of the base, the suction nozzle opening in fluid communication with agitator chamber;

an agitator at least partially provided within the agitator chamber for rotational movement about an axis;

a suction source in fluid communication with the suction nozzle opening for generating a working air stream through the housing along a working air path; and a wiper having a unitary body extending rearwardly within the suction nozzle opening and at least selectively adapted to contact a surface to be cleaned; and a multiply-adjustable coupling provided on the sole plate, the multiply-adjustable coupling forming a connection between the wiper and the sole plate, the multiply-adjustable coupling having opposing inwardly facing walls provided on opposite sides of the sole plate, with the wiper extending between the opposing inwardly facing walls, the multiply-adjustable coupling configured to provide for vertical movement of the wiper relative to the surface to be cleaned and for pivotal movement of the wiper about a pivot axis that is parallel to the axis;

wherein the housing comprises a working air duct having a working air duct inlet that opens to the agitator chamber, the working air duct defining a portion of the working air path with a reduced size.

* * * * *